US006017139A

United States Patent [19]

Lederer

[11] Patent Number: 6,017,139

[45] Date of Patent: Jan. 25, 2000

[54] ELECTRONIC CANDLE

[76] Inventor: Gabor Lederer, 28 Summit Ave., Hackensack, N.J. 07601

[21] Appl. No.: 09/083,148

[22] Filed: May 21, 1998

[51] Int. Cl.[7] ..... F21V 23/04

[52] U.S. Cl. ..... 362/394; 362/392; 362/810; 200/51.01

[58] Field of Search ..... 362/392, 393, 362/394, 810, 212; 200/51.01

[56] References Cited

U.S. PATENT DOCUMENTS 3,943,352 3/1976 Pena May ..... 362/394

4,617,614 10/1986 Lederer ..... 362/392

*Primary Examiner*—Cassandra Spyrou
*Assistant Examiner*—Darren E. Schuberg
*Attorney, Agent, or Firm*—Graham & James LLP

[57] ABSTRACT

An electronic candle having a configuration to emulate that of a wax candle such as a wide cylinder votive candle. The electronic candle contains circuitry to cause emission of random light flickers when activated and a spring loaded two piece switch/timer element and candle housing to effect the activation for a predetermined period of time. Switching is adapted to be effected with position placement of the candle and relative movement between the switch timer element and the housing.

4 Claims, 1 Drawing Sheet

ELECTRONIC CANDLE

FIELD OF THE INVENTION

This invention relates to electric candles which emulate the lighting and appearance of flame candles such as wax votive candles and particularly relates to non-conspicuous switching elements used therewith.

BACKGROUND OF THE INVENTION

Wax candles with open flames are often used for various decorative and religious purposes. A common use is that of votive candles which are arranged in tiers and rows on special stands, in churches. However, if used in quantity or without visual supervision, these candles often pose hazard risks of conflagration. Accordingly, flame candles have often been replaced by electric substitutes which, while providing a safer alternative do not provide the aesthetics for which the candles were used in the first instance. It is disturbing to aesthetic sensibilities to see electrical switches and wires leading to the "candles". The effect of a candle is thus difficult to maintain. In addition, many of the electrical candles provide a steady light which is clearly discernible as not emanating from a "real" candle. Even "candles" with internal switch flickers are made to constantly repeat a pattern which is discernible as not actually emulating a candle flame.

SUMMARY OF THE INVENTION

It is accordingly an object of the present invention to provide an electrical candle emulation device with use of hidden electrical current supply and internal mechanical switch whereby the aesthetic effect of a real candle is maintained for a predetermined electrically timed time interval.

It is a further object of the present invention to provide such electrical candle with random flicker circuitry to further maintain the effect of a random flickering flame of a wax candle.

Generally the present invention comprises an electrical candle body adapted to emulate a candle appearance within an outer surrounding body, wherein the candle body comprises at least two elements which, when combined to fully form the candle, also comprise internal compressive spring loaded switch and timer means to activate the lighting emanating therefrom for a present timed interval. Since the switch is internal, any wiring or other electrical supply source is hidden from view to maintain an illusion of the appearance of a standard votive candle.

The above and other objects, features and advantages of the present invention will become more evident from the following discussion and drawings in which:

SHORT DESCRIPTION OF THE DRAWINGS

FIG. 1 is an exploded view of the candle of the present invention showing the components thereof; and FIG. 2 is a bottom isometric view of the constructed candle showing the engaging elements which form the switching mechanism.

DETAILED DESCRIPTION OF THE INVENTION

Generally the present invention comprises an electric candle emulating device comprised of at least one electric bulb or other electrically powered lighting element, power supply means such as wired connection to an external power source such as an electrical outlet or less preferably (because of power constraints) a rechargeable battery. The aforementioned elements are fully contained within a housing which is movably affixed to a member having transitory switching and timing means for activating the lighting element for a predetermined period of time.

In a preferred embodiment the housing which provides the switching activation comprises a shell element, preferably of cylindrical configuration, which encloses the other elements and which is slightly movably inter-fitted with a spring loaded or resilient base element. The base element comprises or is juxtaposed to a member having switch/timing means embedded therein and structurally configured such that movement (though slight) of the shell element causes a momentary physical contact and compression with the switch/timing means, to activate power to the lighting element and the start of a timed cycle during which the lighting element remains lit. The switch is adapted to remain closed even with release of the shell element and its return to an original position for the timed cycle.

In a highly preferred embodiment, and as more fully described in co-pending application Ser. No. 09/082,875, the lighting element comprises at least two separate vertically aligned light sources and an electronic circuitry which provides a random flicker by means of random directional shunting of current to either or both of the light sources. This emulates the lighting pattern of a wax candle to fully provide the illusion of such light source.

With respect to votive candles and the emulation thereof, the housing, with contained elements is placed on a specially constructed stand such as a marble stand with a central access aperture and a channel. The base is adapted to hold the shell housing and contained elements and to inconspicuously permit a wire or other electrical connection to pass therethrough centrally into the shell housing or bottom thereof for connection to the switch/timing means. The switch/timing means is in turn electrically connected to the lighting elements.

DETAILED DESCRIPTION OF THE DRAWINGS AND THE PREFERRED EMBODIMENT

Figure 1:
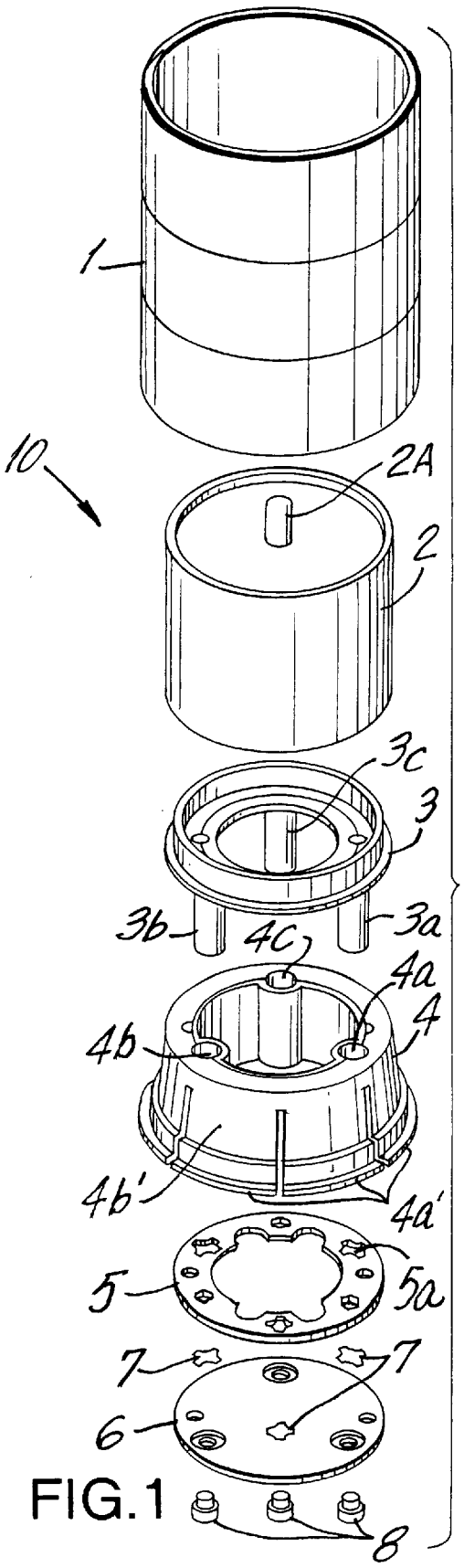

With respect to the drawings, in FIG. 1, a votive structured candle 10 is shown in exploded view with the arranged components of outer sleeve housing 1, adapted to enclose candle upper body 2. The latter is made with integral "wick" portion 2*a* into which a miniature bulb (not shown) is seated.

Upper body 2 is interfitted with stand 3, having hollow legs 3*a–c,* with screw threaded lower sections, which extend away from the interfit upper body 2. These legs are fitted within co-fitting cavities 4*a–c* in base stand 4. Sleeve 1 is fitted over upper body 2 and base stand 4 to provide an integrated unit. Base stand 4 has bevelled horizontal sections 4*b′,* which are adapted to be compressed for insertion into sleeve 1 and then self expanded for holding engagement with the outer sleeve 1. Lip 4*a′* provides a stop for accurate engagement and positioning.

Holding ring 5 covers the bottom of base stand 4 and cover plate 6 is fitted thereover and held in place with screw-in pedestal feet 8 which threadingly engage legs 3*a–c.* Holding ring 5 embodies three apertures 5*a–c* which accommodate three springs 7 which provide a constant pressure against base stand 4. With base plate 6 being provided with a printed circuit and springs 7 being tactile spring switch plates, pressure on any of the springs effects a closure of the circuitry and lighting of the bulb contained in "wick" 2*a.*

Figure 2:
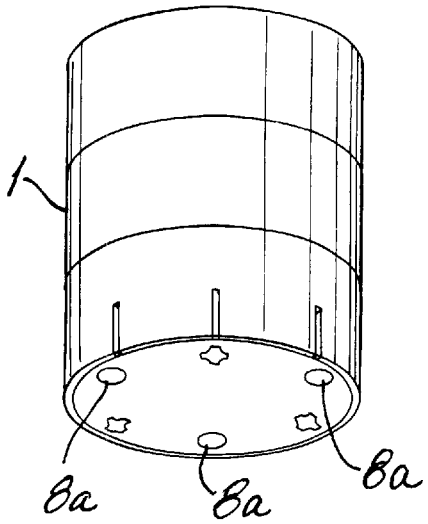

As shown in FIG. 2, screw heads 8*a* of screws 8 provide a pedestal support for the housing 1. Compression (i.e., a downward push) of the top of the housing 1 causes a counter-pressure whereby base stand 4 compresses at least one of springs 7 to activate switch circuitry with timing elements contained in circuit board on base plate 6. The "candle" then remains lit for the pre-determined time set in the circuitry.

It is understood that the above description and illustrated example is only illustrative of the present invention and that changes may be made to arrangement of elements, structure and electrical components and circuitry without departing from the scope of the present invention as defined in the following claims.

What is claimed is:

1. An electric candle emulating device comprised of at least one electrically powered lighting element, power supply means and switch/timing means contained within a housing, wherein the housing is movably affixed to transitory switching and timing means, whereby selected movement of the housing activates the transitory switching and timing means for activating the lighting element for a predetermined period of time.

2. The candle emulating device of claim 1, wherein the housing comprises a shell element which is slightly movably inter-fitted with a spring loaded base element, said base element comprising a member having switch/timing means embedded therein and structurally configured whereby movement of said shell element relative thereto causes a momentary physical contact and compression with the switch/timing means, to activate power to the lighting element and the start of a timed cycle during which the lighting element remains lit.

3. The candle emulating device of claim 2, wherein the switch of the switch/timing means is adapted to remain closed even with release of the shell element and its return to an original position for the timed cycle.

4. The candle emulating device of claim 3, wherein the device emulates the appearance of a votive candle.

* * * * *